US007764146B2

(12) United States Patent
Yu et al.

(10) Patent No.: US 7,764,146 B2
(45) Date of Patent: Jul. 27, 2010

(54) CAVITY MICROWAVE FILTER ASSEMBLY WITH LOSSY NETWORKS

(75) Inventors: Ming Yu, Waterloo (CA); S. Vahid Miraftab, Kitchener (CA)

(73) Assignee: Com Dev International Ltd., Cambridge (CA)

( * ) Notice: Subject to any disclaimer, the term of this patent is extended or adjusted under 35 U.S.C. 154(b) by 147 days.

(21) Appl. No.: 12/139,121

(22) Filed: Jun. 13, 2008

(65) Prior Publication Data

US 2009/0309678 A1 Dec. 17, 2009

(51) Int. Cl.
*H01P 1/20* (2006.01)
*H01P 1/23* (2006.01)
*H01P 3/08* (2006.01)

(52) U.S. Cl. ..... 333/202; 333/204; 333/206

(58) Field of Classification Search ..... 333/202, 333/203, 206, 222, 223, 224, 225, 226, 227, 333/228, 229, 230, 231, 232, 233, 126, 134
See application file for complete search history.

(56) References Cited

U.S. PATENT DOCUMENTS

| | | | | |
|---|---|---|---|---|
| 5,608,363 | A | 3/1997 | Cameron | |
| 6,239,673 | B1 * | 5/2001 | Wenzel et al. | 333/202 |
| 6,664,872 | B2 * | 12/2003 | Channabasappa et al. | 333/202 |
| 6,882,251 | B2 | 4/2005 | Yu et al. | |
| 7,075,392 | B2 | 7/2006 | Smith et al. | |
| 7,400,221 | B2 * | 7/2008 | Kubo et al. | 333/206 |
| 7,482,897 | B2 * | 1/2009 | Puoskari et al. | 333/206 |

FOREIGN PATENT DOCUMENTS

| | | |
|---|---|---|
| EP | 0 336 675 | 10/1989 |
| EP | 0336675 | 10/1989 |
| GB | 879 826 | 10/1961 |
| GB | 879826 | 10/1961 |

(Continued)

OTHER PUBLICATIONS

Andrew C. Guyette et al., The Design of Microwave Bandpass Filters Using Resonators With Nonuniform Q, IEEE Transactions on Microwave Theory and Techniques, vol. 54, No. 11, Nov. 2006.

(Continued)

*Primary Examiner*—Dean O Takaoka
(74) *Attorney, Agent, or Firm*—Isis E. Caulder; Bereskin & Parr LLP

(57) ABSTRACT

A cavity microwave filter assembly for filtering an electromagnetic wave including a plurality of cavity resonator assemblies, where each cavity resonator assembly has a bottom and including at least one lossy element for electromagnetically coupling two elements of the filter assembly, where at least one element is a cavity resonator assembly. The lossy elements provide attenuation in the loss variation of the filter and sharper slopes resulting in an improved Q factor for the filter. A method for realizing lossy elements as resistors requires determining an equivalent circuit model that can be manufactured using resistors, coupling elements, and transmission lines. The method includes representing the resistive element with a resistor, unity admittance inverters and coupling elements and then scaling to determine the resistor and coupling values. The method further includes replacing the admittance inverters with transmission lines of the appropriate length to account for the specific design of the filter.

22 Claims, 20 Drawing Sheets

FOREIGN PATENT DOCUMENTS

| | | |
|---|---|---|
| GB | 1 104 184 | 2/1968 |
| GB | 1104184 | 2/1968 |
| WO | WO 99/40686 | 8/1999 |
| WO | WO99/40686 | 8/1999 |

OTHER PUBLICATIONS

The RF and Microwave Handbook, CRC Press LLC, 2001.

Andrew C. Guyette et al., Exact Synthesis of Microwave Filters with Nonuniform Dissipation, Institute of Microwaves and Photonics, School of Electronic and Electrical Engineering, University of Leeds, Leeds, LS2 9JT UK, Jun. 3, 2007.

Ian Hunter et al, Microwave Filter Design from a Systems Perspective, IEEE Microwave Magazine, Oct. 2007, pp. 71-77.

European Search Report dated Jun. 26, 2009 for European Application No. EP09156510 filed Mar. 27, 2009.

* cited by examiner

CAVITY MICROWAVE FILTER ASSEMBLY WITH LOSSY NETWORKS

FIELD

The embodiments described herein relate to microwave filter assemblies and in particular to an apparatus and method for realizing an assembly of cavity microwave filters with improved Q factor using lossy networks.

BACKGROUND

A microwave filter is an electromagnetic circuit that can be tuned to pass energy at a specified resonant frequency. Accordingly, microwave filters are commonly used in telecommunication applications to transmit energy in a desired band of frequencies (i.e. the passband) and reject energy at unwanted frequencies (i.e. the stopband) that are outside the desired band. In addition, the microwave filter should preferably meet some performance criteria for properties, which typically include insertion loss (i.e. the minimum loss in the passband), loss variation (i.e. the flatness of the insertion loss in the passband), rejection or isolation (the attenuation in the stopband), group delay (i.e. related to the phase characteristics of the filter) and return loss.

A group of microwave filters developed during and since World War II are generally known as waveguide or cavity filters. These filters are hollow structures of different shapes and are sized to resonate at specific frequency bandwidths in response to microwave signals. A common waveguide filter 2 having a plurality of waveguide resonators is shown in FIG. 1A. The walls formed between each pair of adjacent resonator cavities 1 are provided with an iris 3. Each iris 3 provides a means for the near-lossless or conventional coupling of electromagnetic energy between adjacent waveguide resonators. Resonant energy will collect and flow through each waveguide resonator as the signal passes through the waveguide filter 2. The performance may be improved and the cavity size reduced by inserting materials into the resonators.

Referring now to the dielectric filter assembly 4 of FIG. 1B, low-loss dielectric resonators 6 are commonly used to improve performance. Common implementations of a dielectric resonator 6 include positioning a dielectric puck 6*a* on a pedestal 6*b* within the resonator cavity 1. Filters incorporating dielectric resonator assemblies can have quality factors (Q factors) in the range of 8000 to 15,000.

Similarly, in a combline filter assembly 7, as shown in FIG. 1C, metal combline resonators 8 are positioned within the resonator assemblies 1. The combline resonator 8 is normally housed within and is in electrical contact at one end with the metallic cavity 1. Although resulting in a much lower Q factor, combline filter assemblies 7 normally benefit from a reduction in cavity filter size and excellent spurious performance. Under comparable design criteria, a combline filter is approximately half of the size of a dielectric cavity filter but has about half the Q factor.

The size of the cavity and the materials chosen determine the Q factor for a resonator. The Q factor compares the resonant frequency of a system to the rate at which it dissipates its energy. The Q factor of the individual resonators has a direct effect on the amount of insertion loss and pass-band flatness of the realized microwave filter. In particular, a resonator having a higher Q factor will have lower insertion loss and sharper slopes. This results in frequency response that is idealized as a block filter with a flat passband and sharp slopes at the cutoff frequencies. In contrast, filters that have a low Q factor have a larger amount of energy dissipation due to larger insertion loss and will also exhibit a larger degradation in band edge sharpness resulting in a more rounded response.

The comparison in frequency responses 9 in FIG. 2 highlights the effects of an unloaded Q factor on the frequency response of a filter. The frequency response of $Q_1$ shows rounded band edges when the Q factor is 100. High Q factors result in better filter performance as shown in $Q_3$ and $Q_4$.

Filter design is usually a trade off between all of the in-band and out-of-band parameters. A transfer function is a well-known approach to expressing the functionality of a microwave filter in polynomial form. Once a desired transfer function for a desired filter is created, the material type and size of resonators are chosen. The types of resonators used limit the Q factor. In order to increase the Q factor, one often has to increase the size of the resonators resulting in a larger and heavier filter. This is disadvantageous since multi-cavity microwave filters are typically used in various space craft communication systems such as communication satellites in which there are stringent restrictions on payload mass. The finite Q factor (highest possible value selected after the trade off between size and performance is made) will translate to energy dissipation and non-idealized performance. Accordingly, the transfer function of the realized microwave filter will have passband edges that slump downward which causes unwanted distortion and intermodulation.

In order to improve the filter parameters such as loss variation, (band edge sharpness) without resorting to an increase in size and mass, a number of techniques have been discovered. The concept of adaptive predistortion is disclosed by Yu in U.S. Pat. No. 6,882,251 which describes the use of return loss distortion to equalize the transmission response, essentially bouncing back more energy at the band centre to equalize the response in the passband. This method for cross-coupled microwave filters results in an improved filter response in the passband but very poor return loss responses (3-6 dB typical).

Another technique uses resonators with non-uniform Q factors to create non-uniform dissipation in the resonator network. The design by Guyette, Hunger, and Pollard, entitled, "The Design of Microwave Bandpass Filters Using Resonators with Nonuniform Q," describes a method of combining low Q factor resonator paths on the outsides of a multi-resonator microstrip filter to improve the full response when the paths are combined. With this configuration, the multiple signal paths form the full response in a manner similar to active channelized filters. One path forms the response at the band edges, while another path forms the response at the centre of the passband. The full response of the two paths creates a microstrip filter with high selectivity at the expense of increased insertion loss for a given average Q factor.

SUMMARY

The embodiments described herein provide in one aspect, a cavity microwave filter assembly for filtering an electromagnetic wave, said cavity microwave filter assembly having at least two representative nodes and comprising (a) a plurality of cavity resonator assemblies, each said cavity resonator assembly having a bottom and being represented by a node; and (b) at least one lossy element for electromagnetically coupling two nodes of the cavity microwave filter assembly, wherein at least one of the nodes represents a cavity resonator assembly.

The embodiments described herein provide in another aspect, A method for realizing the connection of a resistive element to at least one resonator within a representative node diagram by a physical circuit, the method comprising:

(a) representing the resistive element using a representation of a circuit model, said circuit model comprising a resistor, a plurality of admittance inverters;

(b) scaling the representative circuit model of the resistive element to obtain a desired resistor value and desired value of a coupling element, wherein a coupling element is analogous to an admittance inverter; and (c) transforming the plurality of admittance inverters into a plurality of transmission lines and determining the physical transmission line lengths.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1A:
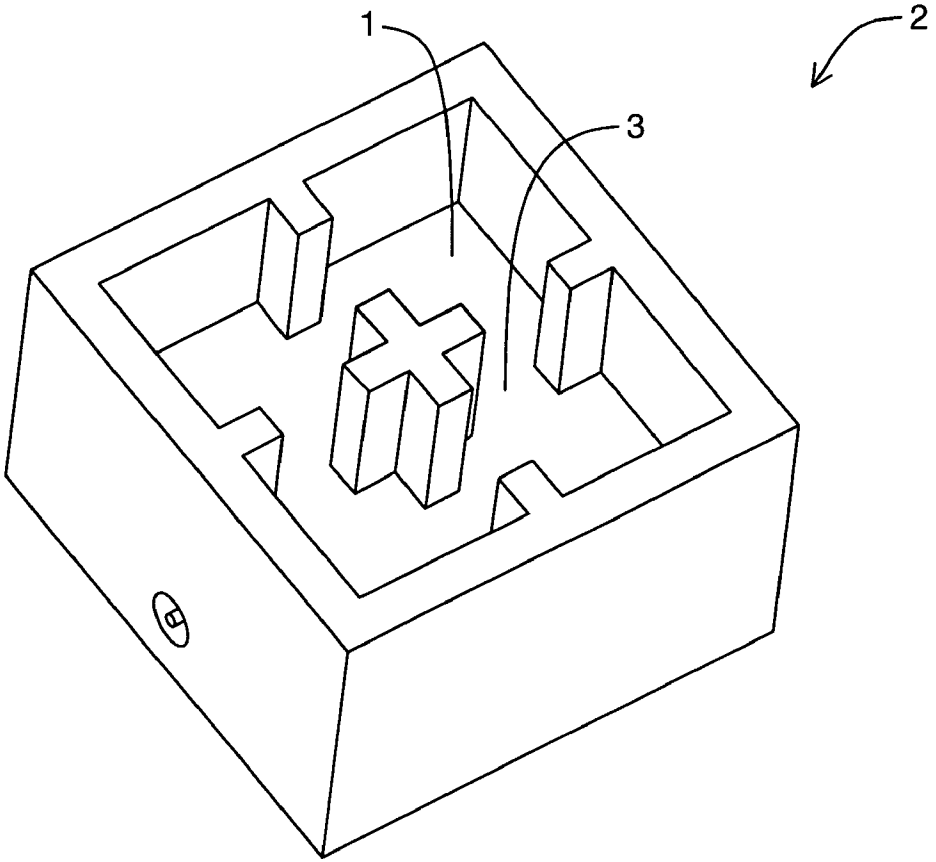
FIG. 1A PRIOR ART
FIG. 1A is a top perspective view of a conventional multi-cavity waveguide filter assembly.
Figure 1B:
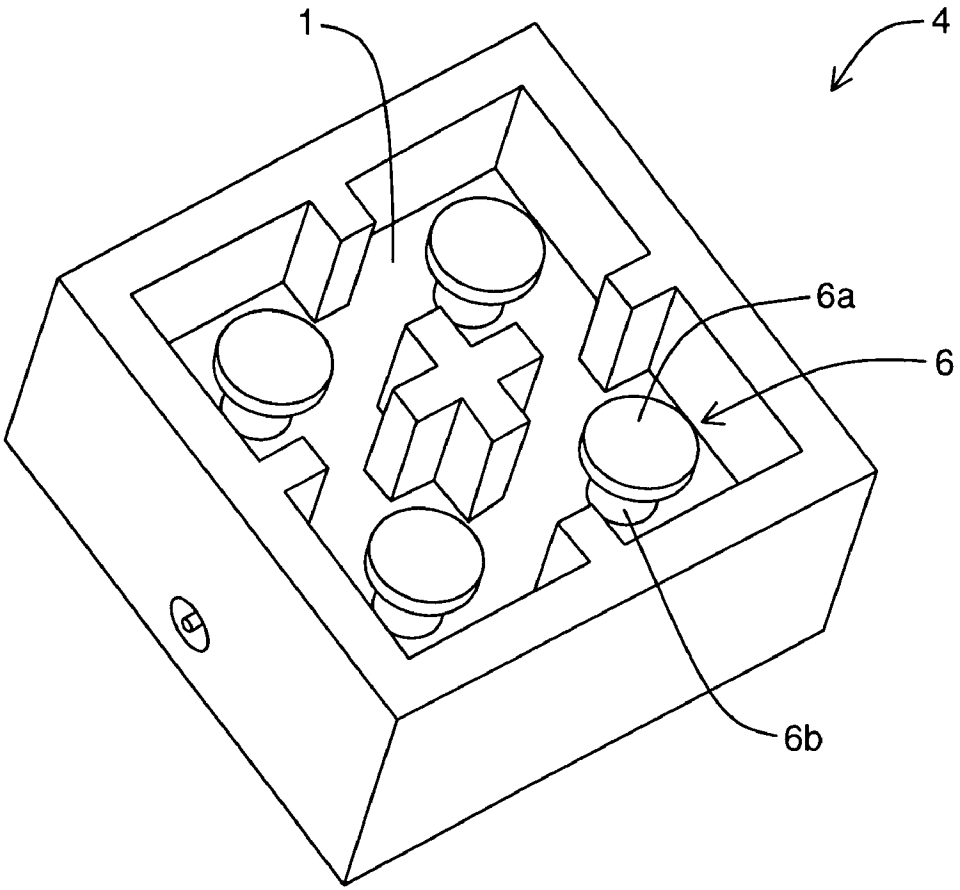
FIG. 1B PRIOR ART
FIG. 1B is a top perspective view of a conventional multi-cavity dielectric filter assembly.
Figure 1C:
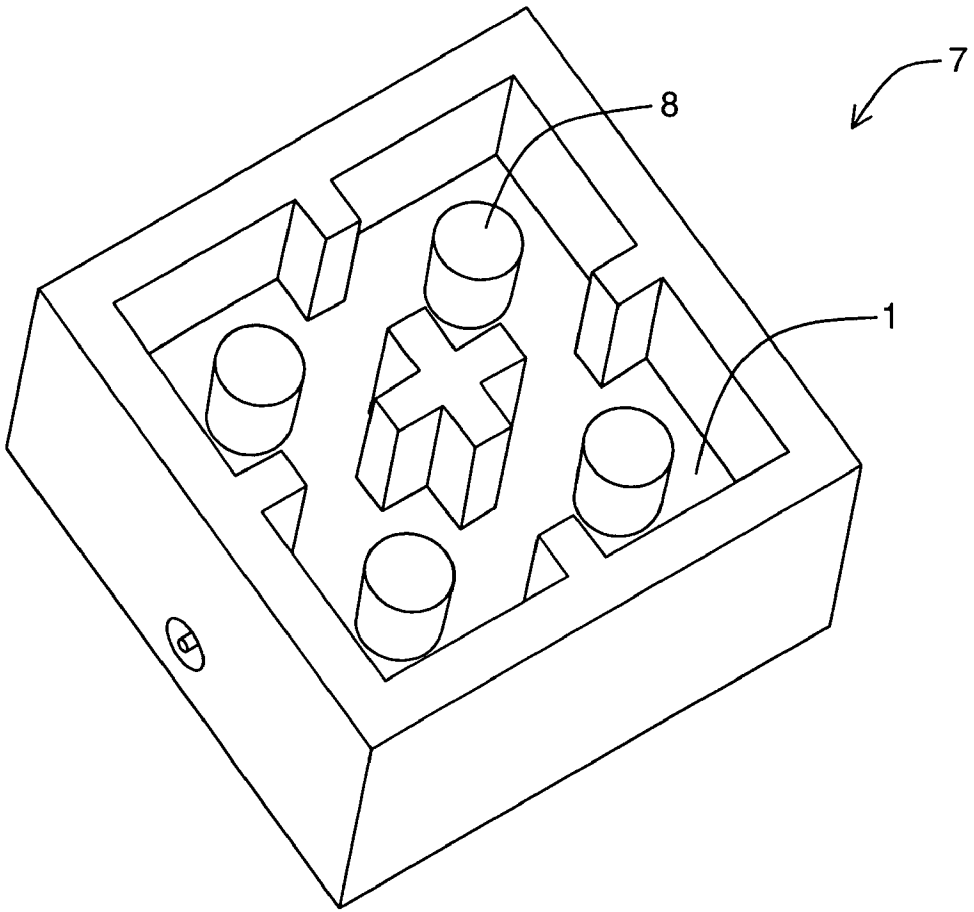
FIG. 1C PRIOR ART
FIG. 1C is a top perspective view of a conventional multi-cavity combline filter assembly.
Figure 2:
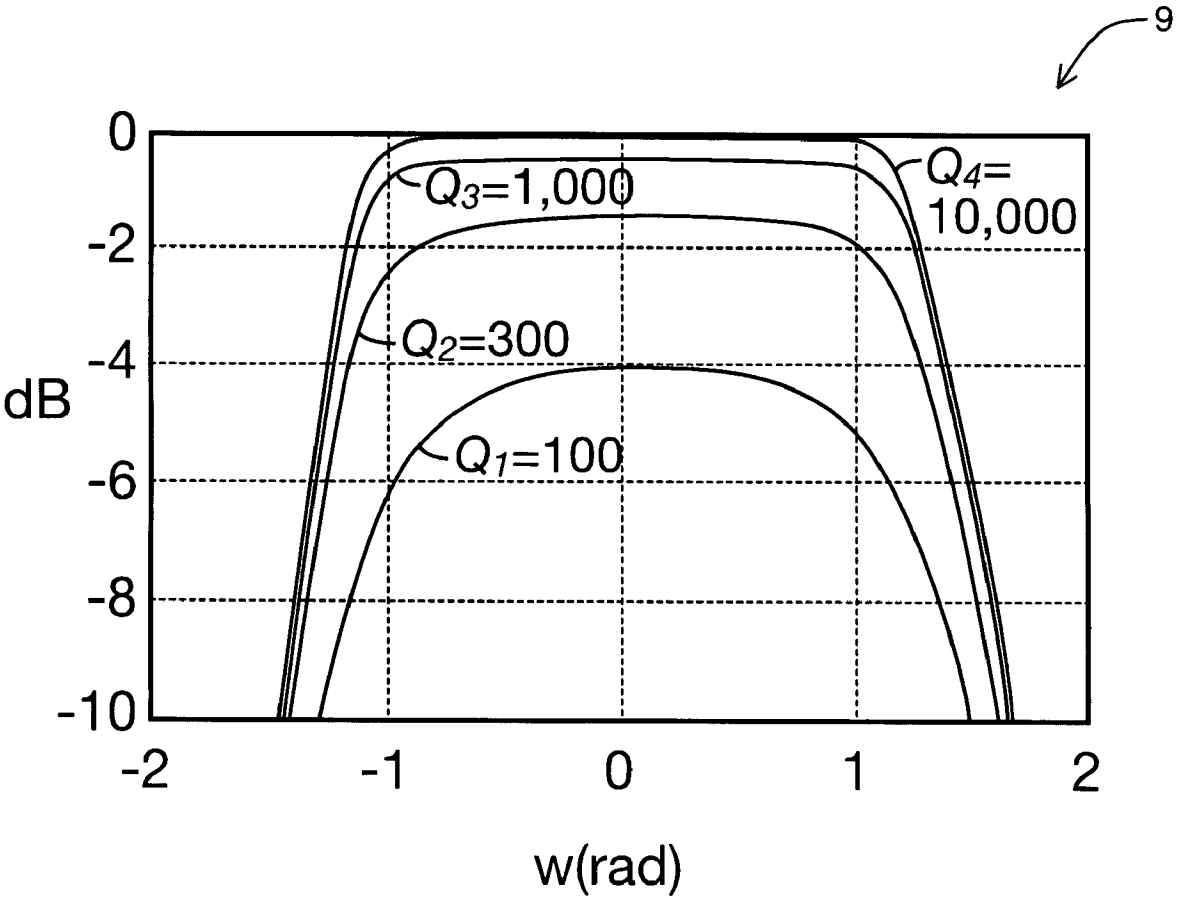
FIG. 2 PRIOR ART
FIG. 2 is a graphical representation of the performance of microwave filters with different unloaded Q factors.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Generally speaking, the inventors have realized that an effective method for improving the effective Q factor of multi-cavity filter assemblies is to insert lossy or dissipative networks into a cavity microwave filter assembly design to correct for the undesired responses from finite Q factor resonators. Whereas previous designs in the prior art involving cavity resonators utilized pre-distortion techniques to fill in a non-uniform passband response by reflecting energy back at the centre frequency, the embodiments discussed trade off additional insertion loss for a non-uniform dissipation at the centre frequencies. This results in the response of a higher effective Q factor filter. Accordingly, a generalized filter assembly model involving multiple cavity resonators with both conventional and resistive coupling elements has been determined to improve the loss variation and the sharpness of the passband edges while maintaining a high return loss at the passband frequencies.

Lossy networks can be added to multi-cavity filter assemblies that utilize resonators with a low Q factor to allow the filter to emulate the performance of higher Q factor resonators. This is beneficial since a resonator having a low Q factor may be lighter and smaller than a resonator having a high Q factor. Accordingly, the smaller and lighter filter using lower Q factor resonators designed with lossy networks to enhance performance are suited for use in spacecraft applications in which the size and mass of payloads are severely constrained. Lossy networks can also be added to multi-cavity filter assemblies that utilize resonators with a high Q factor to improve the performance of the filter.

Figure 3:
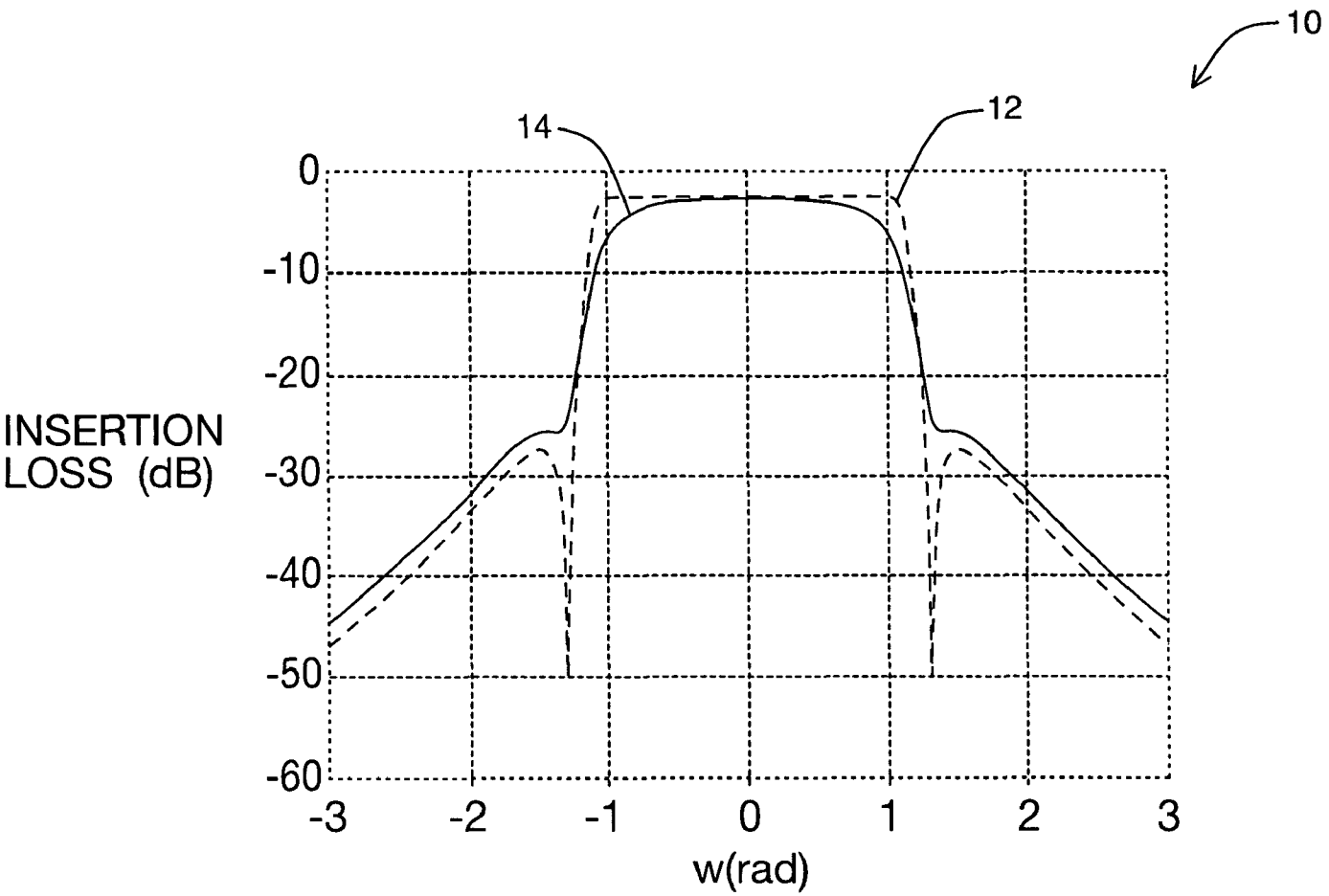
FIG. 3 is a graphical representation showing how a lossy network can improve the performance of the unloaded Q factor of a normalized filter response function.

Referring to FIG. 3, the improvements to the filter response due to the addition of lossy networks can be seen in the filter comparison 10 of two normalized filters 12 and 14 with normalized cutoff frequencies at 1 radian. The frequency response 14 for a filter with finite Q factor is shown having rounded loss variation. Although the addition of lossy networks results in an increase in insertion loss, the resulting frequency response 12 contains improved loss variation in the passband and the increased sharpness at the band edges.

These improved characteristics result in a higher effective Q factor. The frequency response 12 of the filter with lossy networks is normalized (shifted) as shown in FIG. 3 to match the maximum point in the frequency response 14 for the filter with finite Q for a direct filter comparison 10. However, it is understood that the introduction of lossy elements increases the insertion loss. Introduced gain or other techniques known in the art can also be used to compensate.

Once a normalized design has been corrected and modeled, an ordinary person skilled in the art may apply the appropriate transforms to create a plurality of filter types including, but not limited to, low pass filters, high pass filters, bandpass filters, and bandstop filters.

Figure 4:
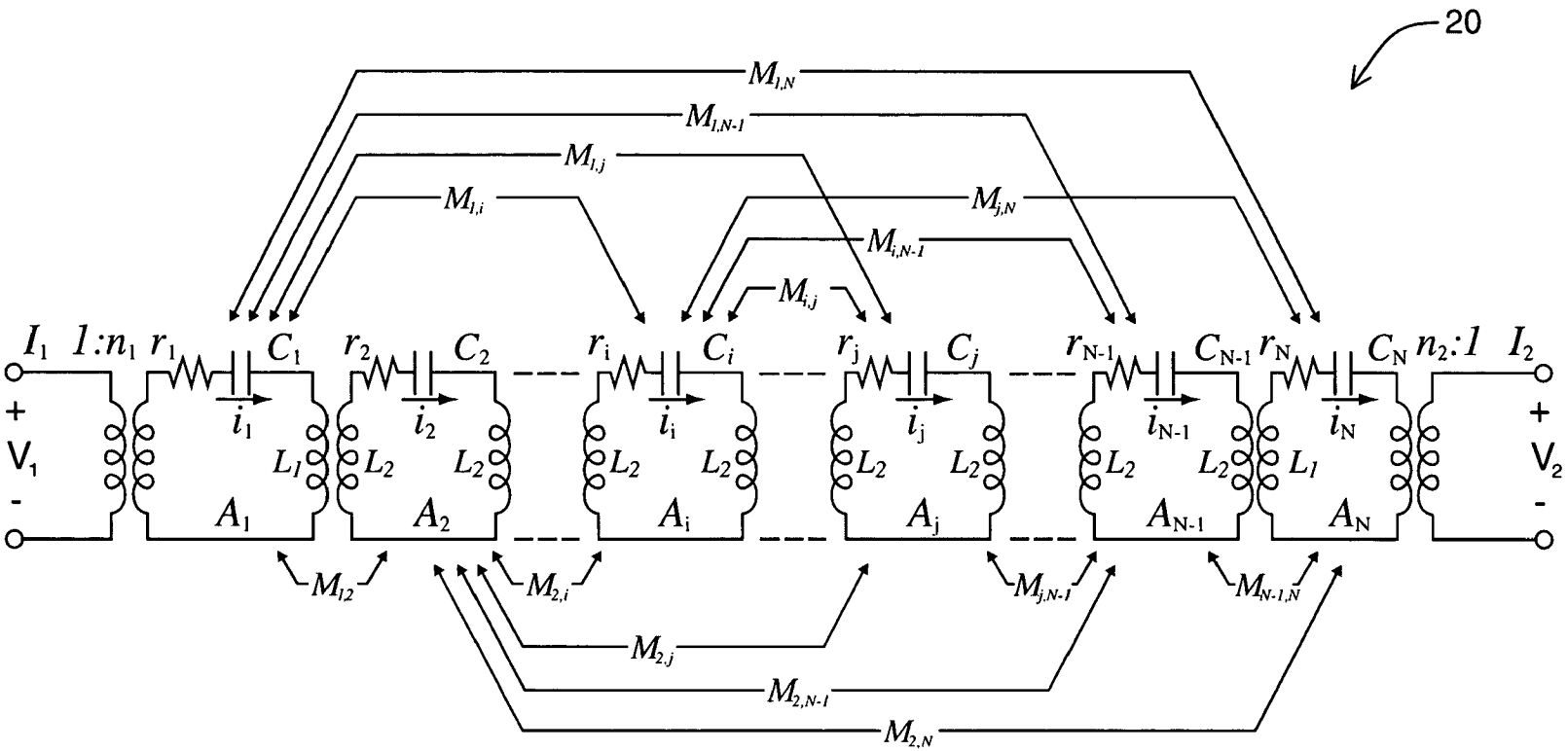
FIG. 4 is a graphical representation of an embodiment comprising a plurality of cavity resonators and complex coupling, through coupling matrix components $M_{i,j}$, between each of the cavity resonators.

FIG. 4 represents an embodiment of a generalized n-cavity filter assembly 20 that introduces lossy elements using a mixture of conventional, resistive, and complex coupling. Individual resonator assemblies $A_i$ with finite Q factors are depicted by the series connection of two inductors $L_k$ and $L_l$, a capacitor, and a resister, $r_i$. Different resonator assembly depictions are possible and FIG. 4 is only illustrative of one particular embodiment.

The individual resonator assemblies $A_i$ in the generalized n-cavity filter assembly 20 are coupled to each other according to a complex coupling matrix M. The coupling matrix components $M_{i,j}$, which populate the coupling matrix M, and may be complex with both real and imaginary components coupling the $i^{th}$ and $j^{th}$ nodes in the filter assembly 20. The traditional conventional coupling, or real coupling, is a special case of complex coupling, where the imaginary component is negligible and only the real component remains. In a purely resistive coupling, the real component is negligible and the imaginary component dominates.

Lossy elements in a microwave cavity filter assembly occur when both real components and imaginary components are found in the coupling matrix M (i.e. when the matrix M is complex). Complex coupling between two resonator assemblies $A_i$ and $A_j$ occurs when the coupling component $M_{i,j}$ of the coupling matrix M is complex. If this is the case, then resonator assemblies $A_i$ and $A_j$ will have both real coupling (conventional coupling) and imaginary coupling (resistive coupling).

For a realizable passive reciprocal circuit, the imaginary parts of the diagonal elements, $M_{ii}$ of the coupling matrix M, may be negative. This results in positive resistor values when manufacturing the circuit.

FIG. 4 is one embodiment of a multi-cavity filter assembly 20 that includes lossy elements as part of the coupling matrix M. It should be known to one skilled in the art that additional models involving lossy elements and with different resonator assembly designs are possible. Additional embodiments comprising lossy elements in the transmission paths and within the resonator assemblies $A_i$ are described below. Other embodiments comprising multiple resonator assemblies filtering electromagnetic energy in combination with lossy networks are also possible.

Figure 5A:
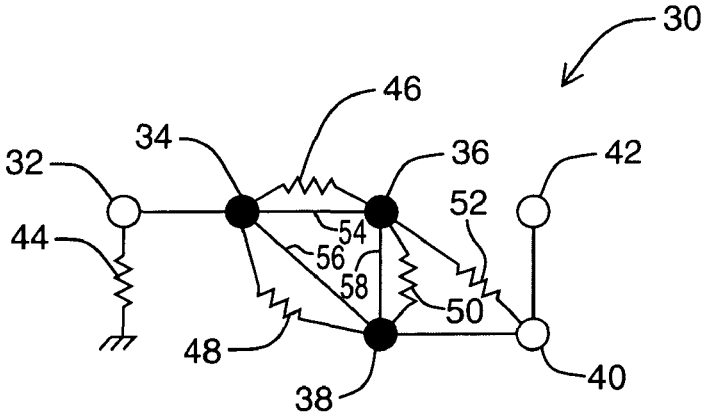
FIG. 5A is a representative node diagram for an asymmetric 3-resonator filter with complex coupling.

FIG. 5A is a representative node diagram illustrating an exemplary embodiment of a cavity microwave filter assembly 30 with lossy networks. A node diagram is well known to those skilled in the art. Referring to FIG. 5A, black filled circles represent resonators nodes 34, 36, and 38 and open circles represent non-resonating nodes 32, 40, and 42. Straight lines 54, 56, and 58 represent conventional coupling (real coupling) between resonator nodes and resistive elements 46, 48, and 50 represent resistive coupling (imaginary coupling) between resonator nodes.

Referring to FIG. 5A, complex coupling occurs between the three resonators 34, 36, and 38. Using the coupling between nodes 34 and 36 as an example, resistive element 46 and conventional coupling 54 provide complex coupling as both real and imaginary coupling occur at the same time. Similarly, resistive elements 48 and 50 and conventional coupling elements 56 and 58 provide complex coupling for nodes 34 and 38 and nodes 36 and 38, respectively. The resonators can be of a number of types including, but not limited to, waveguide resonators, dielectric resonators, and combline resonators. The resonators may operate in single or dual mode.

Figure 5B:
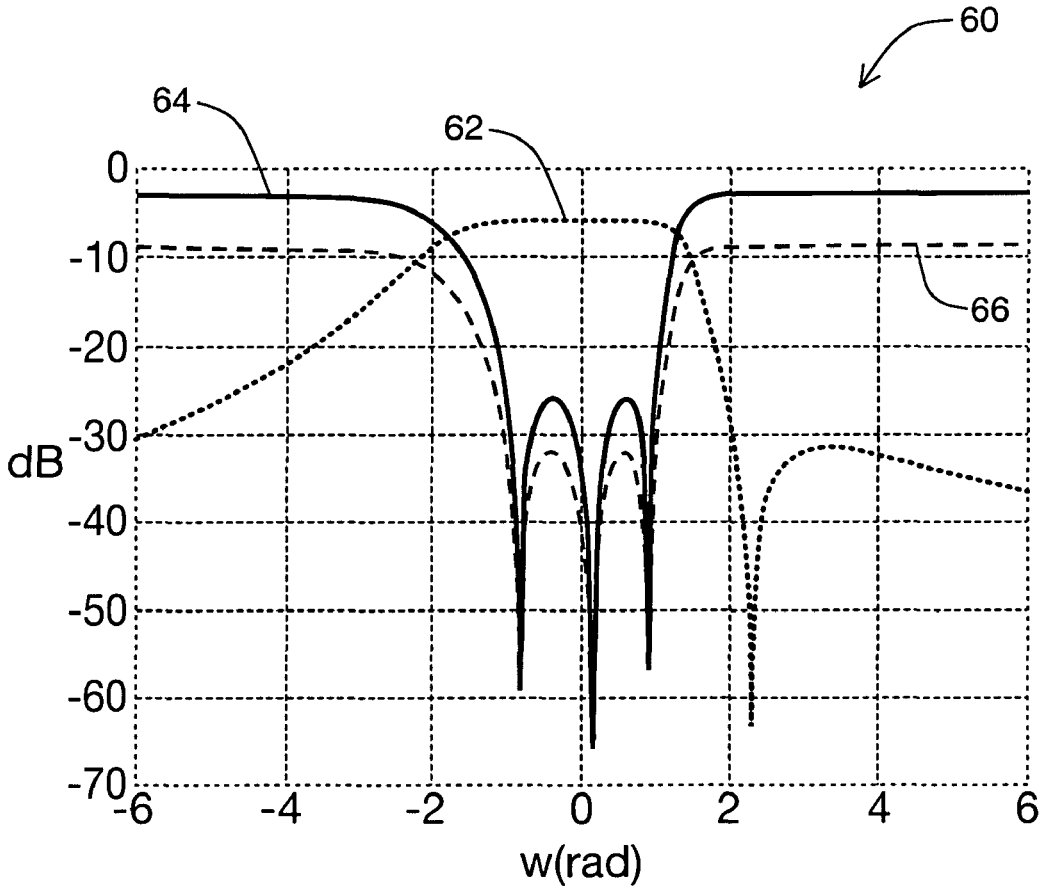
FIG. 5B is a graphical representation of the modeled RF performance of the filter assembly of FIG. 5A.

FIG. 5B shows the normalized model response for the asymmetric filter depicted in FIG. 5A with $S_{21}$ 62, the forward transmission coefficient of the system. The frequency response shows a sharp cutoff frequency on the high frequency band edge. Overall, this circuit shows insertion loss of over 6 dB, but is flat with little loss variation in the passband and exhibits strong rejection. The input and output return loss represented by $S_{11}$ 64 and $S_{22}$ 66 respectively, show high loss of over 25 dB in the passband frequencies. A useful feature of this filter in particular applications is that the input and output return losses are not equal, signaling the response of the network is not symmetric. The introduction of lossy networks allows the input return loss 64 and the output return loss 66 to be independently adjusted.

Figure 6A:
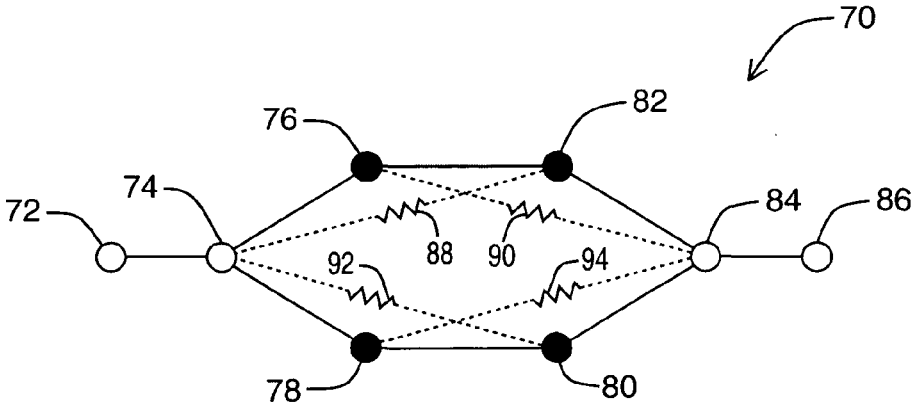
FIG. 6A is a representative node diagram for a four-resonator filter with both conventional and resistive coupling.
Figure 6B:
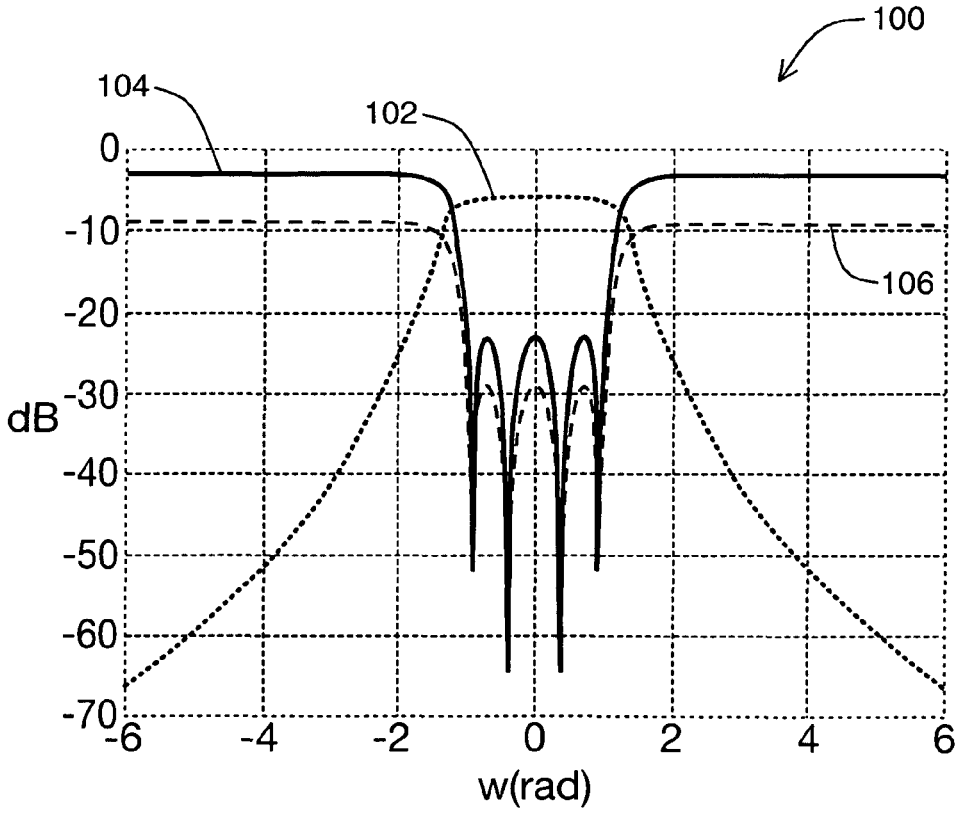
FIG. 6B is a graphical representation of the modeled RF performance of the filter assembly of FIG. 6A.

Referring to FIG. 6A, a representative node diagram of a lossy transveral four-resonator filter with conventional and resistive coupling is embodied. Nodes 74, 76, 78, 80, 82, and 84 in this embodiment utilize one of conventional coupling or resistive coupling to realize the desired frequency response. Resistive coupling is used between nodes 74 and 82, nodes 74 and 80, nodes 76 and 84, and nodes 78 and 84. In this embodiment, conventional coupling is not shared among the same resistive coupling node paths. Instead, conventional coupling between resonating nodes and conventional coupling between resonating nodes and non-resonating nodes occurs between nodes 74 and 76, 76 and 82, 82 and 84, 74 and 78, 78 and 80, 80 and 84. FIG. 6B shows the normalized frequency response 102, $S_{21}$, with normalized cutoff frequencies at ±1 radian. The modeled circuit also displays asymmetric input 104 and output return loss 106.

Additional embodiments are possible for one skilled in the art within the generalized description of a cavity microwave filter assembly with lossy networks. Many cavity microwave filter assembly configurations involving lossy networks may be able to meet the desired frequency response of high effective Q factor filters while benefiting from the size and weight advantages of lower Q factor components.

Figure 7:
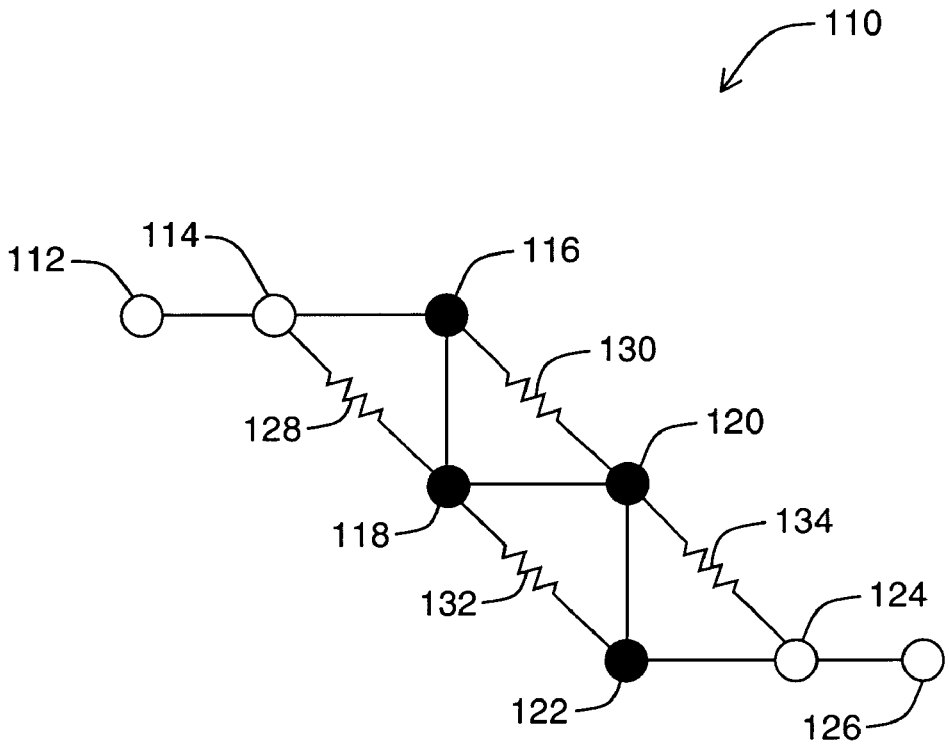
FIG. 7 is a representative node diagram of a four-resonator Chebyshev filter with both conventional and resistive coupling.

FIG. 7 shows another exemplary embodiment of a cavity microwave filter assembly with lossy networks. Here, a node diagram of a 4-pole Chebyshev filter can be designed based on a desired transfer function. Resonator assemblies of any type may be designed using this process. The filter assembly depicted uses resistive coupling to improve the Q factor of the 4 resonators 116, 118, 120, and 122.

In order to realize the node diagram involving both conventional and resistive coupling, it is necessary to use a method for synthesizing a resistive element from an RF node diagram into a physical three-dimensional circuit. It is not possible to resistively couple two resonators together by simply placing a resister between them, as microwave resonator sizes are comparable to the operating wavelengths where the impedance and reflection of the input signal become important. Without compensation, a microwave resistor would distort the filtered signal, adding reflections and losses into the microwave cavity filter assembly.

In order to realize an RF filter with lossy elements, it is necessary to compensate for a number of undesirable effects. Firstly, microwave resistors come with a phase shift, which would cause the response to deviate from the designed one. Secondly, there is no direct realization for a resistor connecting to a microwave resonator compared to the circuit model. Transmission lines must be used. Thirdly, it is sometimes preferable to have 50-ohm transmission lines in the design in order to match impedances and maximize power transfer.

The graphical representation in FIG. 7 shows, but is not an exhaustive list, of two situations where lossy elements connect to resonators 116, 118, 120, and 122. In one situation, a resistive element connects two resonators, 116 to 120, and 118 to 122, while in another a resistive element connects one resonator, 118 and 120, to a non-resonating node, 114 and 124, respectively. The circuit realizations will use the same principles for realization but result in different physical arrangements.

Figure 8A:
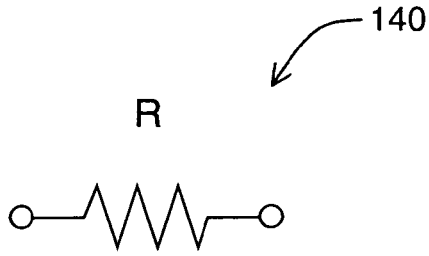
FIG. 8A is the graphical representation of a resistive element connecting two resonator nodes in a cavity microwave filter.
Figure 8B:
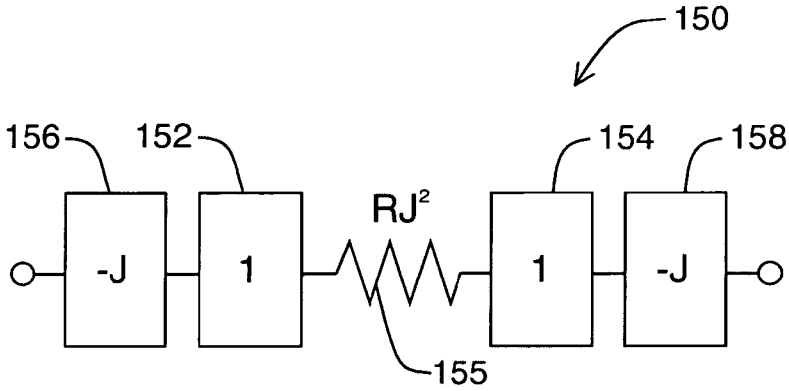
FIG. 8B is a graphical representation of the equivalent circuit of FIG. 8A using a transform where the resistive element has been replaced by a network containing a resistor and admittance inverters.
Figure 8C:
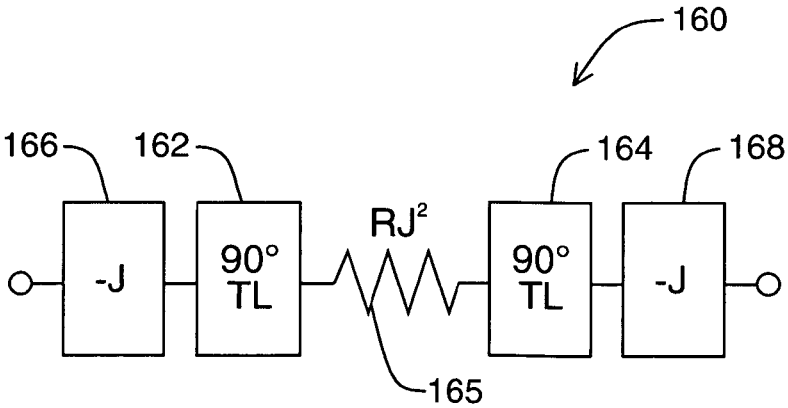
FIG. 8C is a graphical representation of the equivalent circuit of FIGS. 8A and 8B, where the admittance inverters have been replaced with quarter-wave transmission lines and coupling elements.

FIGS. 8A, 8B, and 8C detail one method for coupling two resonator nodes with a resistive element. A series of substitutions using circuit model equivalents in addition to scaling allows the general resistive element to be realized. Represented as a resistor in the node diagram 110 of FIG. 7, a possible physical embodiment of a resistive element in a cavity microwave filter assembly uses a resistor, transmission lines, and coupling elements. This method may be used to synthesize physical embodiments of the resistive elements 130 and 132 from the node diagram 110.

Three elementary definitions using admittance inverters (also known as J-inverters or coupling elements), known in the art can be used to help realize a circuit transformation. First, pairs of offsetting admittance inverters (pairs of admittance inverters of value 1 (unity) with reversed polarities) can be added anywhere between nodes. Second, the definition of a J-inverter allows for a series impedance of value R to be transformed to shunt impedance with value 1/R and unity (value of 1) admittance inverters on either side of the shunt with offsetting polarity. Finally, the third definition with respect to J-inverters allow for nodal scaling where J-inverters gets scaled by a value J and impedance gets scaled by $1/J^2$.

To get to a realizable circuit model, the first step is to replace the resistive element with a representative circuit equivalent. From the resistor 140 of value R, the resistor is transformed to shunt with unity admittance inverters of different polarity on either side. Next, nodal scaling is applied by value J to the shunt network. The impedance 1/R is scaled by $1/J^2$. Finally, the shunt admittance is transformed back to a series impedance with additional offsetting unity admittance inverters (of offsetting polarity). A final set of nodal scaling is applied to get the values for the admittance inverter of value J. Referring to FIG. 8B, the resistive element 140 with resistance R of FIG. 8A can be represented by a resistor 155, and admittance inverters 152, 154, 156, and 158. Admittance inverters 152 and 154 are unity admittance inverters and admittance inverters 156 and 158 have a value of J. The series resistor 155 is now scaled to a value of $RJ^2$.

In the circuit model 150 of FIG. 8B, the admittance inverters are shown as either unity admittance inverters 152 and 154, or coupling elements 156 or 158, denoted by the letter J. Although circuit equivalents, coupling elements 156 and 158 are used to couple the resistive element to the resonators and are differentiated from the admittance inverters 152 and 154.

This novel transformation to the coupling at the ports allows for easy circuit realization. The value of the coupling can be easily tuned by repositioning the coupler inside the resonator cavity. The value of J can be arbitrarily selected. In some situations, negative coupling is easier to realize, but positive coupling is also possible.

Finally, FIG. 8C can then be obtained by substituting unity admittance inverters 152 and 154 for transmission lines 162 and 164 with the appropriate lengths. A simple admittance inverter known in the art is a quarter wave transmission line. Coupled admittance inverters can be strung together to produce transmission lines of varying length. With a representative circuit model 160 comprising the appropriate resistor value, transmission line lengths and coupling values, the equivalent circuit model 160 can then be realized using standard manufacturing methods known in the art.

Figure 9A:
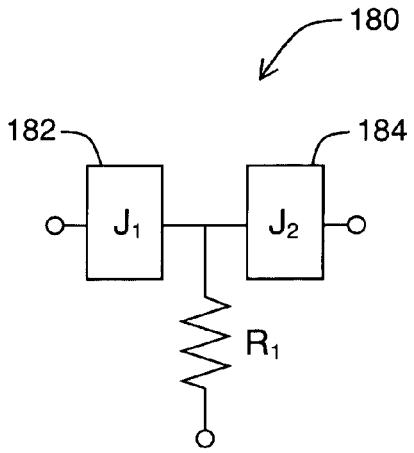
FIG. 9A is a graphical representation of a 3-port network with a resistor and coupling elements.
Figure 9B:
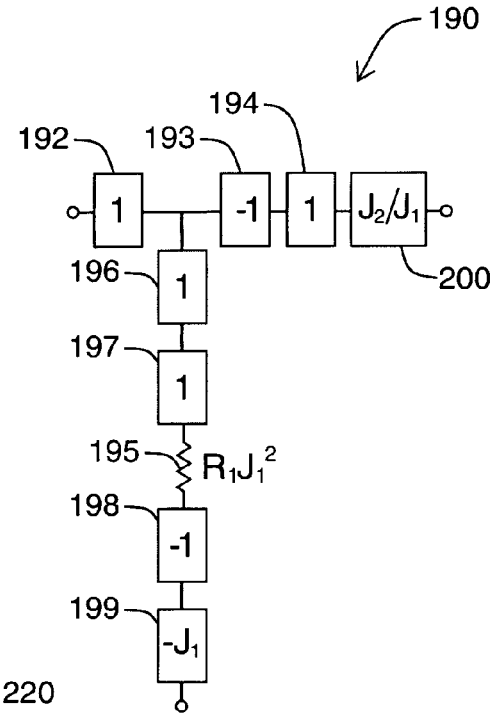
FIG. 9B is a graphical representation of an equivalent circuit model to that shown in FIG. 9A using a transform involving unity admittance inverters and coupling elements.
Figure 9C:
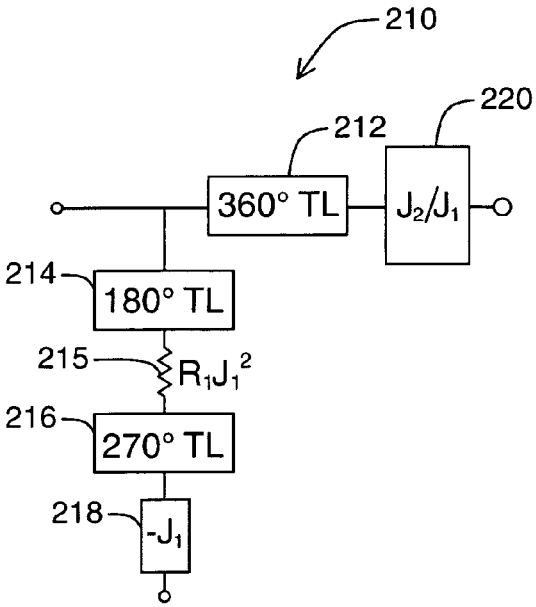
FIG. 9C is a graphical representation an equivalent circuit model to that shown in FIGS. 9A and 9B with transmission lines and coupling values.

A similar approach can be taken using a resistive element to couple a resonator node to a non-resonating node. FIGS. 9A, 9B, and 9C detail one method using a series of substitutions and scaling that allows a model of a resistive element, represented as a resistor in the node diagram 110 of FIG. 7, to be realized in a cavity microwave filter assembly. This method may be used to synthesize physical embodiments of the resistive elements 128 and 134 from the node diagram 110 shown in FIG. 7.

FIG. 9A shows the basic coupling network seen at node 114 and 124 in FIG. 7. Referring now to FIG. 9A, the coupling network 180 can be modeled as a resistive element of value $R_1$, and coupling elements 182 and 184. The coupling elements 182 and 184 represent the physical coupling between the resistor of value $R_1$ and the source node 112 or load node 126 and the resistor and the resonator 116 and 122, respectively.

Next, an equivalent model circuit for the coupling network 180 can be represented as a resistor 195 and coupling elements 199 and 200.

To get to the circuit model in FIG. 9B, the nodal transformations explained above are once again used. Pairs of offsetting unity admittance inverters are placed between nodes. In addition, a series of nodal scaling is applied to provide the coupling value at 199. First three pairs of offsetting unity admittance inverters (also equivalent to 360 degree transmission lines) are inserted. Then the series resistor 195 connected to offsetting unity admittance inverters are transformed to a shunt resistor. By scaling the shunt resistor node by $J_1$, converting the shunt resistor back to a series resistor 195 with offsetting admittance inverters 196, 197, 198, and 199 at both sides, and with some additional scaling, the circuit equivalent 190 in FIG. 9B is obtained.

The circuit in FIG. 9B can be simplified recognizing that a simple unity admittance inverter (+1) known in the art is a quarter wave transmission line, while a unity admittance inverter −1 is a 3-quarter wave inverter. Strings of admittance inverters can be coupled together to produce transmission lines of varying length. Transmission lines 212, 214, and 216 can then replace the plurality of admittance inverters accounting for the required phase characteristic. Because the unity admittance inverter 192 is to be coupled to the source node 112 or load node 126 from the node diagram 110 in FIG. 7, the quarter-wave transmission line can be removed and incorporated with the source node. With the appropriate resistor value, length of transmission lines, and coupling values determined, one skilled in the art can now manufacture the equivalent circuit model 210 for the coupling network 180.

This method of realizing a resistive element in a microwave circuit provides many benefits. Using quarter wave transmission lines allows the extra electrical length associated with a microwave resistor to be absorbed in the transmission paths. In addition, a capacitive (negative) coupling values at the two sides are usually easier to implement and favorable for cavity resonator assemblies as they can be easily adjusted for tuning purposes by trimming the wire or using screws (not shown) or other methods. Tuning screws can also be used for tuning positive coupling, but adjusting the wire length is not as easy as in the negative coupling realization. Thirdly, the coupling values at both ends can be arbitrarily selected for a more reasonable realization based on the physical conditions of the design. It is also known in the art that one can assume non-unity J-inverters in the middle of these kinds of resistive networks, which result into transmission lines with different characteristic impedances.

The model circuits shown in FIGS. 8C and 9C are easily realizable using planar technology and a series resistor. Single or multi-layer planar technology may use common microstrip and stripline technology. Utilizing the exemplary equivalent resistor models and transforms, one embodiment of the invention as shown in FIG. 7, has been designed and manufactured.

Figure 10A:
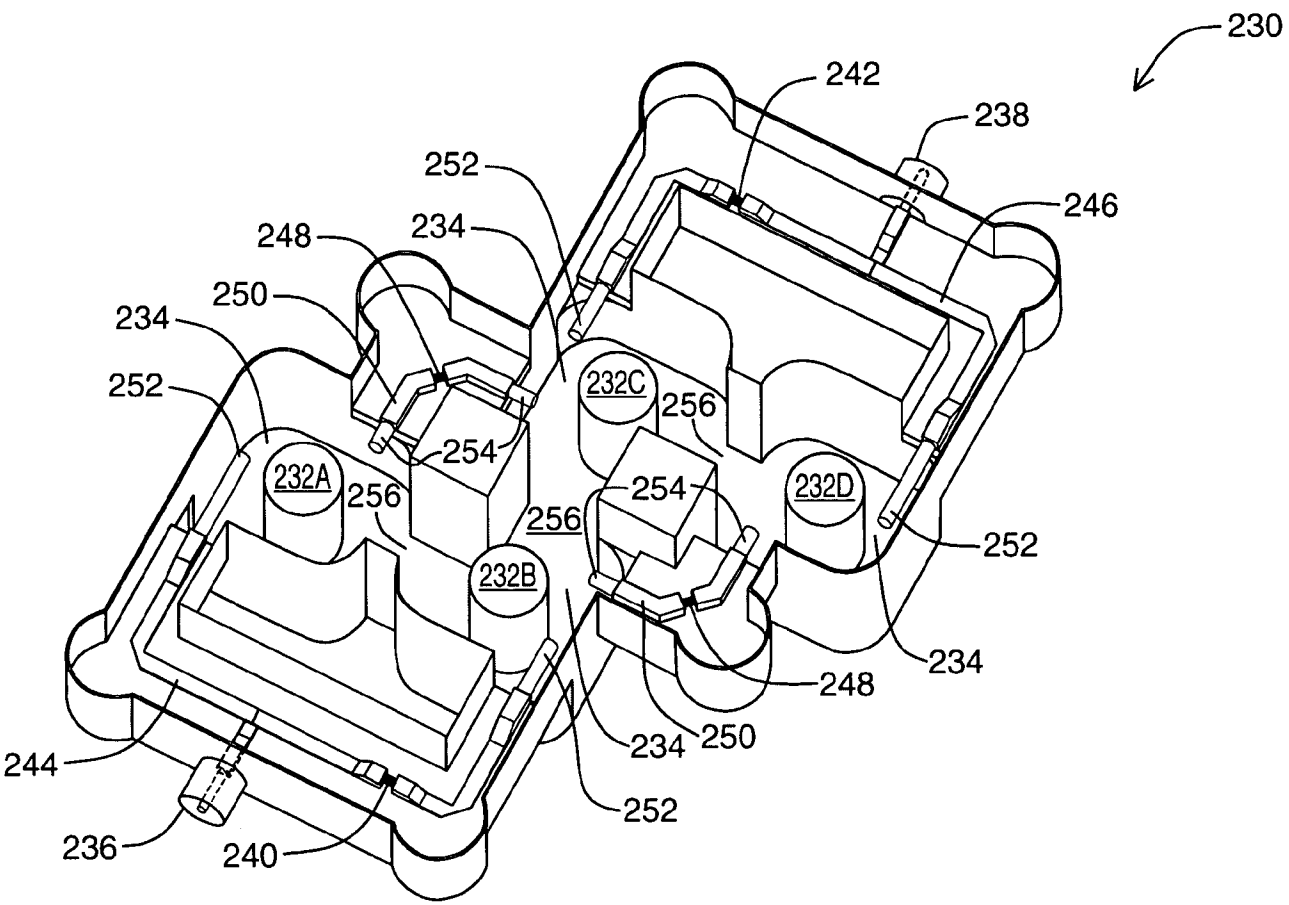
FIG. 10A is a top perspective view of the lossy four-pole Chebyshev filter represented by the node diagram of FIG. 7 using combline resonators, microstrip circuitry and coupling between certain nodes.

FIG. 10A illustrates a cavity microwave filter assembly 230 that uses planar technology with chip resistors 240, 242 and 248 inside the filter cavity to add loss to the four-pole Chebyshev filter assembly. The embodiment uses combline resonators 232A, 232B, 232C, and 232D, with a Q factor of approximately 2000. The offset pattern seen in the manufactured filter assembly 230 is based on the desired transfer function. This design allows planar resistive elements, including chip resistors 240, 242, and 248 and transmission lines 244, 246, and 250 to be incorporated within a three-dimensional microwave cavity structure.

Figure 10B:
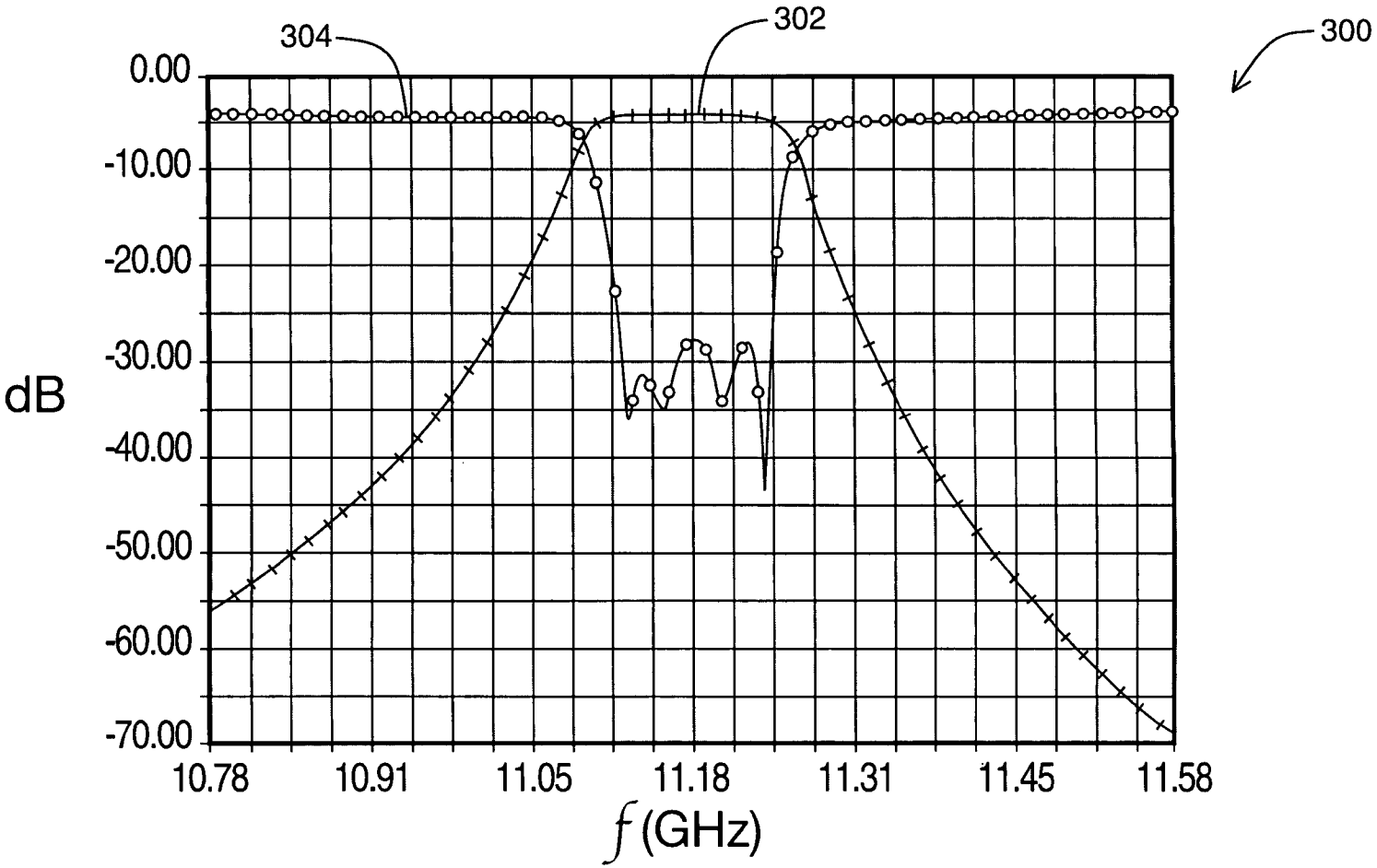
FIG. 10B is a graphical representation of the measured response of the filter of FIG. 10A showing the measured frequency response and return loss.

Referring to FIG. 10B, the measured response 302 of the filter assembly shows excellent response at the passband frequencies and sharp cutoff at the band edges. The insertion loss is manageable and can be compensated for, if desired. The measured return loss 304 of 25 dB also shows excellent characteristics with little reflection in the bandpass range. As seen by the measured response 302, large improvements to the Q factor can be achieved. Filter designs comprising lossy elements may create filters of very high, if not infinite Q factor through the proper incorporation and tuning of the required lossy elements.

Referring now to FIG. 10A, shown therein is the interior of the embodied cavity microwave filter assembly 230 with lossy networks 244, 246, and 250. The filter assembly 230 comprises an input probe 236 for receiving input electromagnetic energy and an output probe 238 for providing output filtered electromagnetic energy. The input probe 236 and the output probe 238 both use a transmission line 244 and 246, respectively and have coupling elements 252 for coupling energy to/from the resonator assemblies 234.

The filter assembly 230 further comprises a plurality of resonator assemblies 234. Each resonator assembly 234 has a combline resonator 232A, 232B, 232C, and 232D. The combline resonators 232 in this situation allow cavity microwave filter assemblies 230 of reduced size compared to dielectric or waveguide filter assemblies while providing excellent spurious signal response. The irises 256 couple the resonator assemblies sequentially (i.e. resonator 232A is coupled to resonator 232B, resonator 232B is coupled to resonator 232C, and so on), although cross coupling among the resonator assembly nodes may also be incorporated. The size and shape of the resonator assemblies 234, combline resonators 232A, 232B, 232C, and 232D, and coupling irises 256, are created to obtain the frequency response for a desired passband and stopband. The lossy networks in the form of complex coupling may be used to improve the shape of the frequency response as if the resonator assemblies had a higher Q factor.

Conventional and resistive coupling is also included in the embodiment shown in FIG. 10A. Using the methods for realizing resistive elements shown herein in FIGS. 8A, 8B and 8C and FIGS. 9A, 9B, and 9C, the resistive elements 128, 130, 132 and 134 in the node diagram 110 in FIG. 7, can be transformed into realizable chip resistors 240, 242 and 248, transmission lines 244, 246, and 250, and negative coupling 252 through metal wires. These components have been especially arranged as shown herein to accommodate for the undesirable effects propagated by the resistive elements (i.e. the chip resistors, 240, 242, and 248).

Figure 11A:
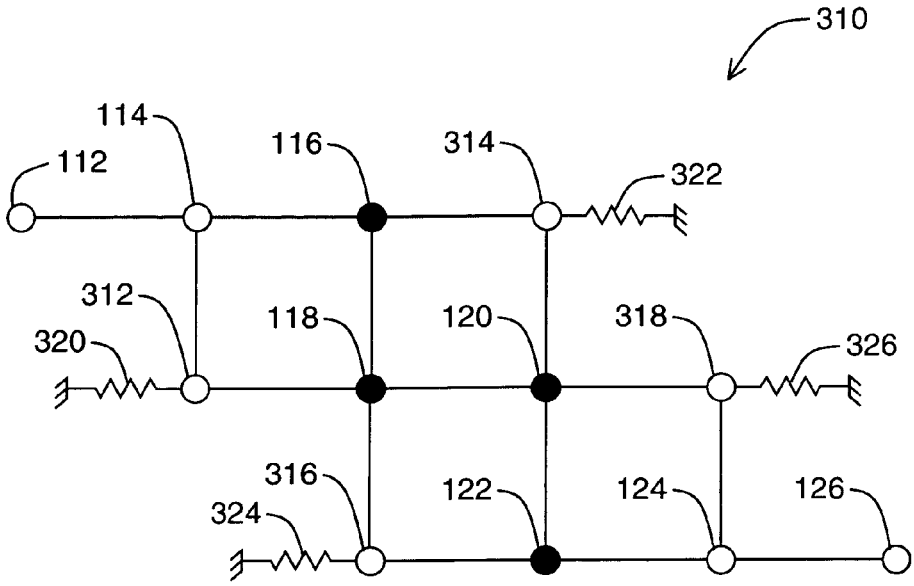
FIG. 11A is a graphical representation equivalent to the node diagram of FIG. 7 using network transformations.

FIG. 11A represents an equivalent node diagram 310 and possible embodiment for the filter assembly described in FIG. 7 where shunt resistors replace the resistive elements coupling the resonators. Referring to FIG. 7, the node diagram 110 is transformed to create an equivalent lossy network 310. The two resistive elements, 130 and 132, connecting resonating nodes 116 to 120, and nodes 118 to 122, and the two resistive elements, 128 and 134, connecting resonator nodes, 118 and 120 to non resonating nodes, 114 and 124, respectively, have been replaced with a shunt resistor terminated to ground coupled to two adjacent nodes.

When the shunt resistors 320, 322, 324, and 326 are placed in parallel to the shunt capacitors inherent in the model of non-resonating nodes 312, 314, 316, and 318, a lossy, low-Q factor resonator is formed. When properly modeled, the resistive elements can be used incorporate lossy elements into the filter design.

Figure 11B:
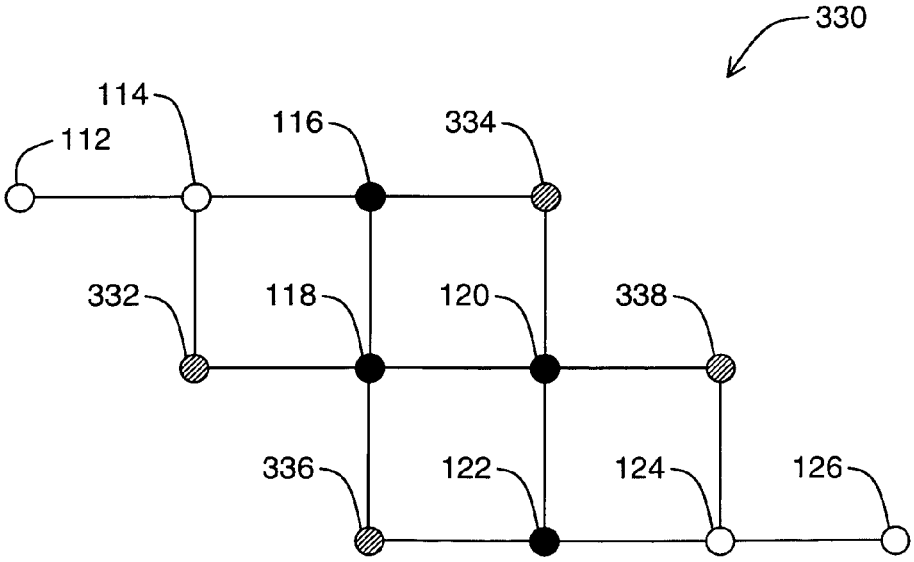
FIG. 11B is a graphical representation equivalent to the node diagram of FIG. 7 using lower Q factor resonators to act as the resistive elements in the circuit.

FIG. 11B shows an additional embodiment of an equivalent node diagram for the filter assembly described of FIG. 7. Lossy resonators 332, 334, 336, and 338 replace the shunt resistors 320, 322, 324, and 326 in FIG. 11A.

Referring to FIG. 11B, lossy elements may be realized using resonators 332, 334, 336, and 338. The Q factor for these resonators 332, 334, 336, and 338 may have Q factors the same or different than the original resonators 116, 118, 120, and 122. Because the Q factor relates to the rate at which energy is dissipated, different Q factor resonators will add additional loss to a cavity microwave filter assembly.

Figure 12A:
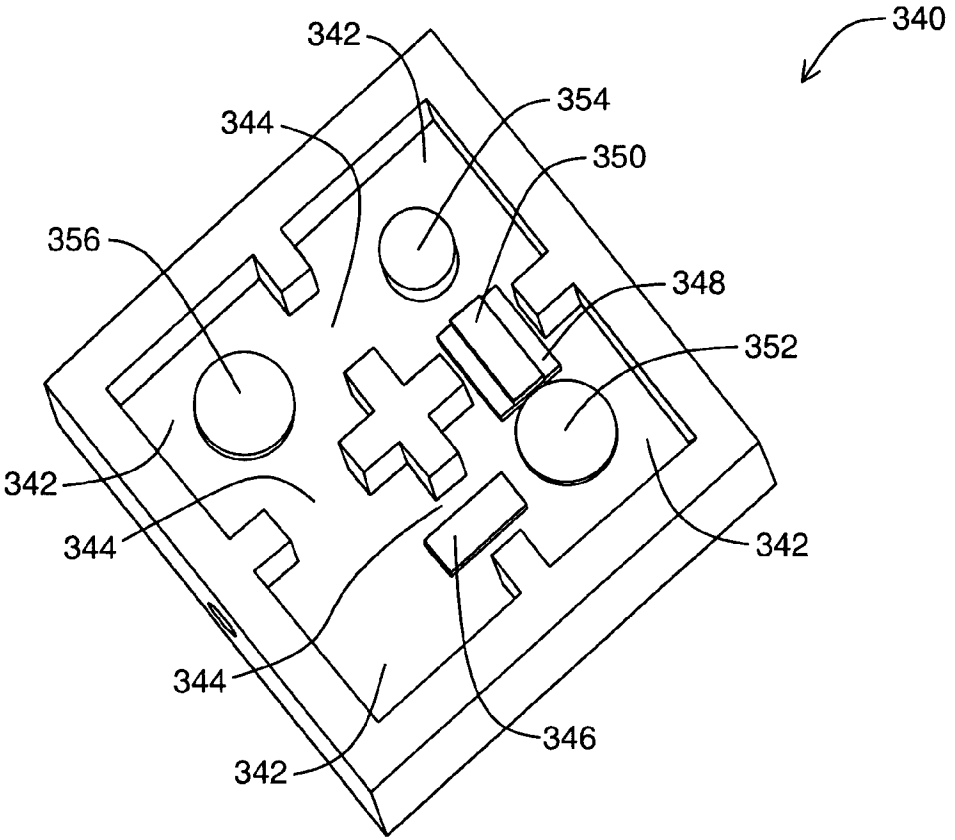
FIG. 12A is a top perspective view of a multi-resonator filter assembly that uses lossy material between adjacent resonator assemblies.
Figure 12B:
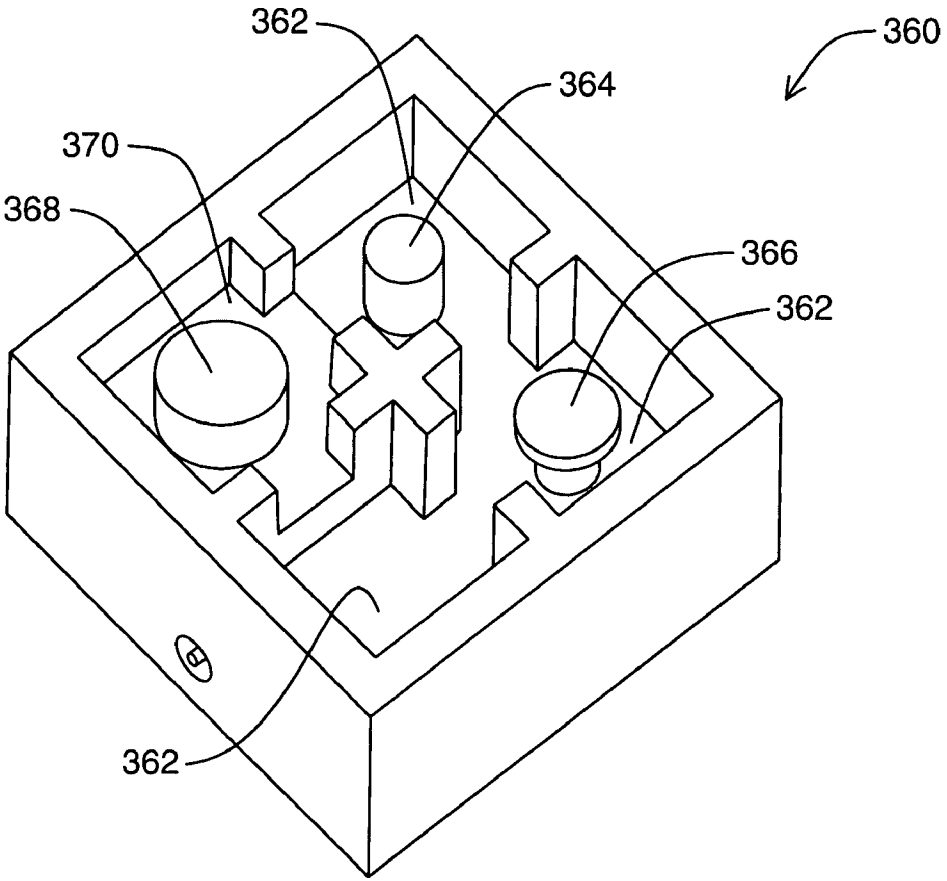
FIG. 12B is a top perspective view of a multi-resonator filter assembly that inserts loss into a waveguide resonator by changing the cavity size and inserting a lossy material into the cavity.

Different Q factor resonator assemblies can be achieved using a number of factors comprising the size of the cavity, the introduction of a lossy material, and combining filter types together such as waveguide, dielectric and combline resonators. An embodiment allowing resonators to act as the lossy elements will allow the cavity microwave filter assembly 330 to be housed within the same cavity housing. The benefit of this embodiment using only cavity resonators allows for higher input and output power tolerances and easier tuning using screws or other methods known in the art. Another benefit is the ease of production, as most, if not all of the elements may be manufactured using the same cavity technology FIGS. 12A and 12B show two embodiments of cavity microwave filter assemblies where lossy materials have been positioned within the filter cavity structure to act as a lossy element. FIG. 12A shows a cavity microwave filter assembly 340 where lossy materials, 346, 348 and 350, positioned in irises 344 coupling adjacent resonator assemblies 342. As the signal passes through the iris 344 with lossy material 346, energy is dissipated in the lossy element. Similarly, materials may be layered on top of each other. In one embodiment, a material 348 supports a lossy material 350. The lossy materials may include, but are not limited to, conductive materials, dielectric materials, or ferrite materials.

Referring now to FIG. 12B, one embodiment of a cavity microwave filter assembly 360 shows many methods for changing the Q factor of the resonator assemblies. The addition of a lossy material 368 inside the resonator assembly 370 may change the Q factor of the resonator, allowing the resonator assembly to act as the lossy element improving the response of the cavity microwave filter assembly 360 by the controlled dissipation of the center passband frequencies. Another embodiment of establishing different Q factor resonator includes changing the size of the resonator assembly 370 in comparison to other resonator assemblies 362 within the cavity microwave filter assembly 360. A smaller resonator assembly 370 may dissipate energy at the desired passband frequencies using known cavity effects.

Another embodiment of a cavity microwave filter assembly 360 has lossy elements comprising different Q factor resonators. FIG. 12B includes a combline resonator 364, a dielectric resonator 366, and a hollow waveguide resonator in its resonator assemblies 362.

Figure 13A:
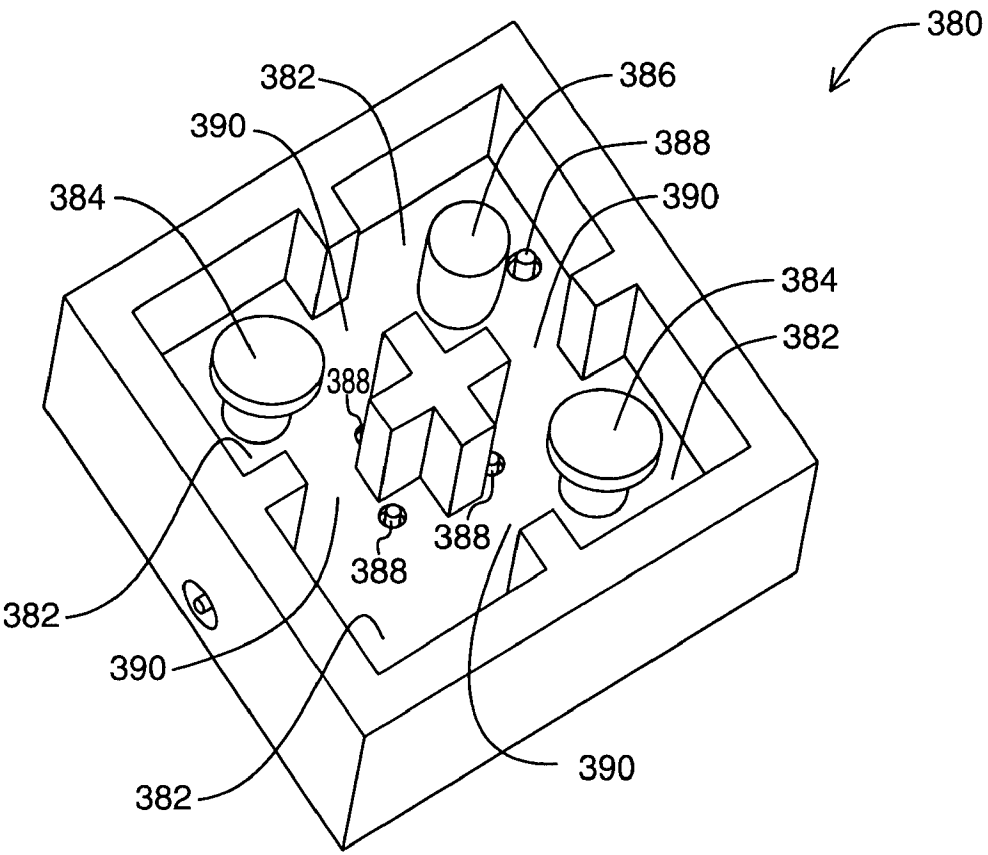
FIG. 13A is the top perspective view of a multi-cavity filter that includes a combination of combline, dielectric and waveguide resonators with througholes to the underside of the multi-cavity filter assembly.
Figure 13B:
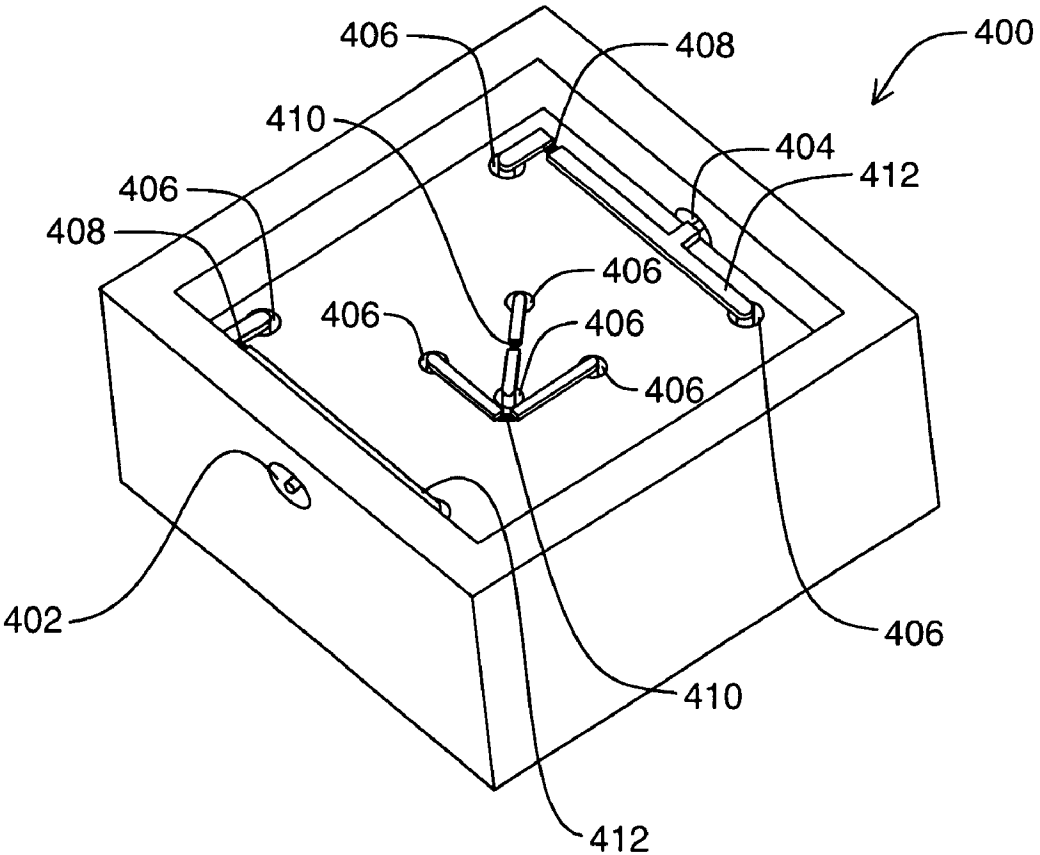
FIG. 13B is the bottom perspective view of the multi-cavity filter of FIG. 13A showing planar circuitry connected to the resonator assemblies using through holes to incorporate resistive coupling into the filter design.

FIGS. 13A and 13B illustrate how different combinations of resonator assemblies can be combined together to implement lossy elements. In FIG. 13A, an embodiment shows the top perspective of a cavity microwave filter assembly 380 that includes a plurality of resonator assemblies 382 that may each include a waveguide (382 without an additional resonator element), dielectric 384, and combline 386 resonator. A different embodiment may also have multiple resonator assemblies 382 stacked on top of each other (not shown). In all embodiments, tuning and coupling screws may be used to create the desired response of the cavity microwave filter assembly 380.

Additional components can be connected underneath the cavity microwave filter assembly 380 using through holes 388. FIG. 13B shows the underside of the cavity microwave filter assembly 380 of FIG. 13A. Planar circuitry is attached to the underside of the cavity microwave filter assembly and connects to the resonators 382, 384, and 386 seen in FIG. 13A by through holes 388 and 406. Dielectric or other non-conducting materials may be used to fill the holes to provide mechanical stability. The chip resistors 408 and 410, and transmission lines 412 introduce additional resistive coupling into the cavity microwave filter assembly 400. Chip resistors 408 and 410 on the underside of the assembly 400 act in parallel to the conventional coupling 390 that occurs between the resonator assemblies 382 in FIG. 13A, creating loss to improve the bandpass loss variation and cutoff frequency sharpness of the filter response.

Figure 14A:
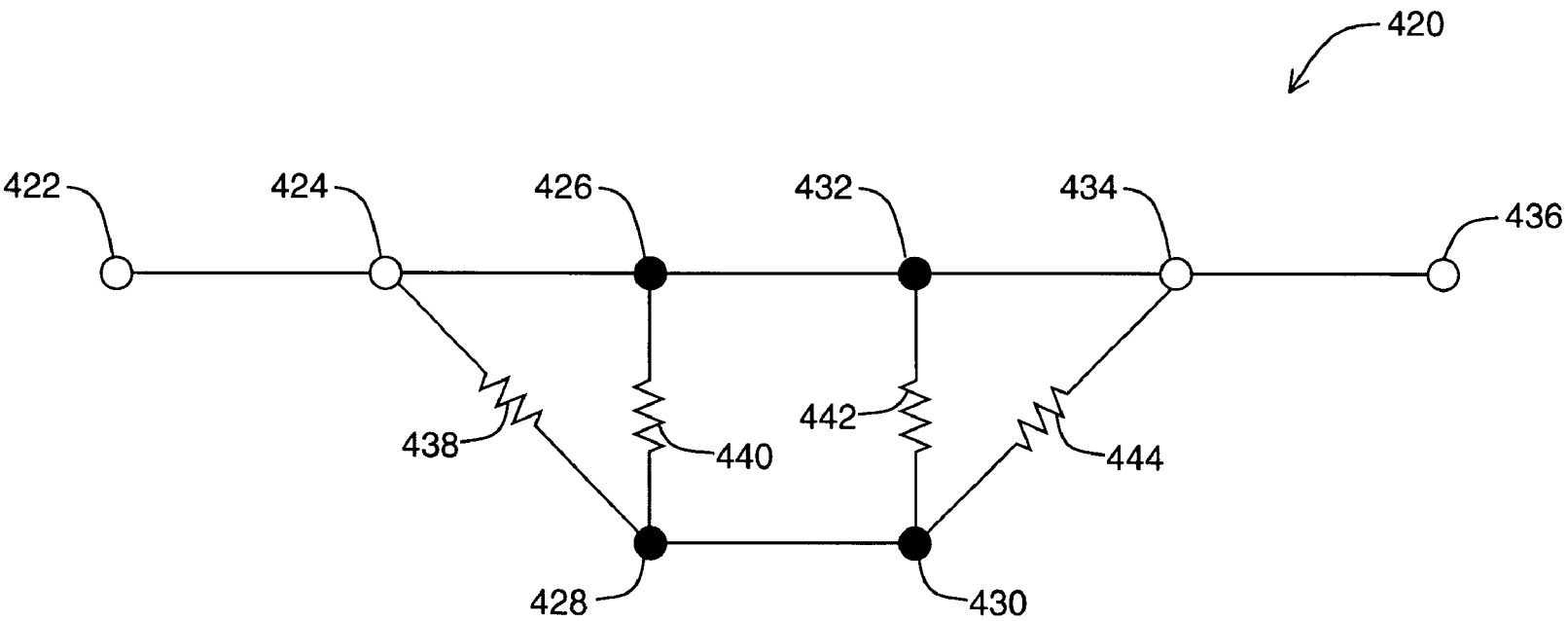
FIG. 14A is a graphical representation of a four-resonator filter using complex coupling.
Figure 14C:
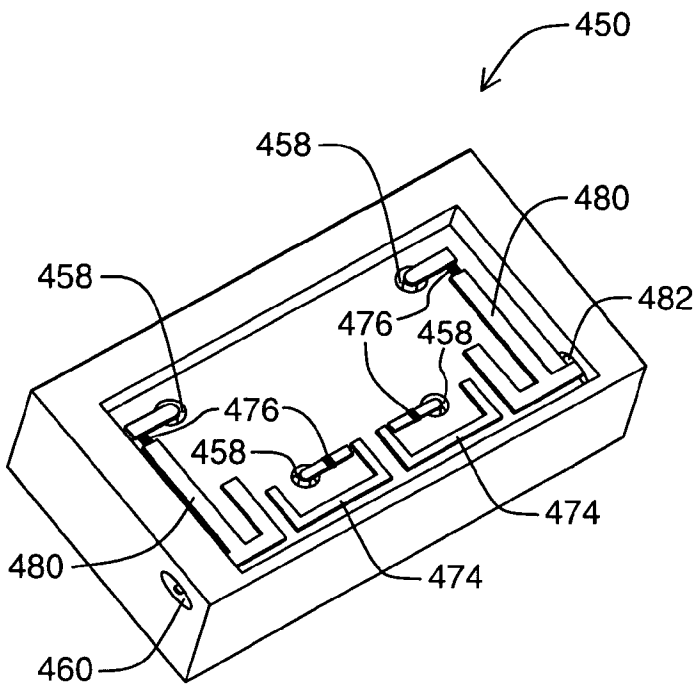
FIG. 14C is the bottom perspective view of the multi-cavity filter of FIGS. 14A and 14B showing two planar resonators coupled to the resonator assembly cavities using through holes.
Figure 14B:
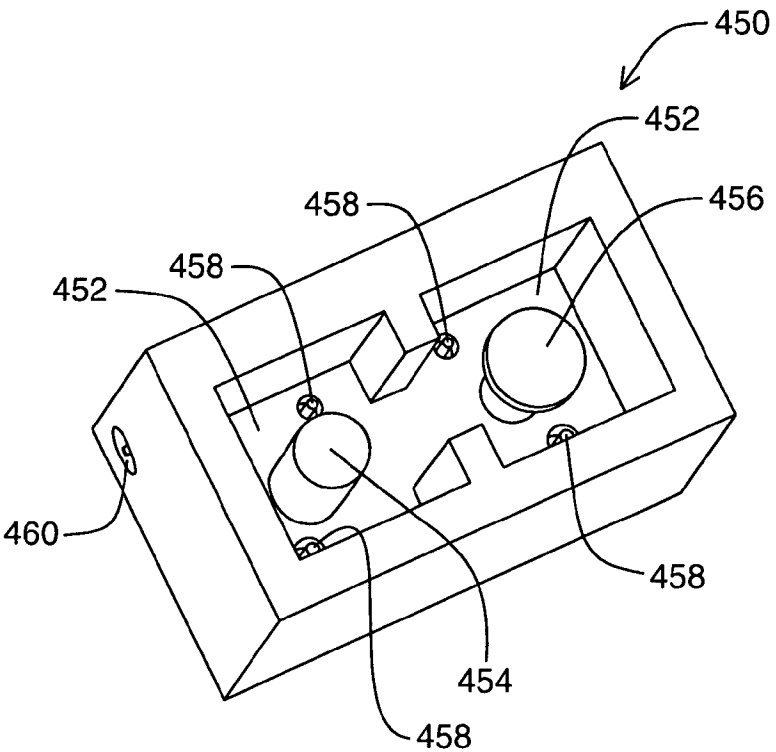
FIG. 14B is the top perspective view of the multi-cavity filter of FIG. 14A containing two cavity resonators with through holes to the underside of the multi-cavity filter assembly.

Referring now to FIGS. 14B and 14C, shown therein is the top perspective and bottom perspective of a cavity microwave filter assembly with lossy networks for the node diagram shown in FIG. 14A. This embodiment comprises cavity resonator assemblies 452, using combline resonator 454 and dielectric resonator 456, and planar resonators 474 to create a filter of reduced size and weight using the improvements in frequency response from the addition of lossy networks. Filters of this type are especially useful for space applications where there are payload constraints with respect to size and weight.

The filter comprises an input probe 460 for receiving input electromagnetic energy and an output probe 482 for providing output filtered electromagnetic energy. In this embodiment, the two probes are coupled to the planar resonators 474. Another embodiment may have the two probes coupled directly to the cavity resonator assemblies 452. The benefit of coupling the input 472 and output 482 probe directly to the cavity resonator assemblies is the amount of power transmitted and the ease of manufacturing provided.

The two cavity resonator assemblies 452, with resonators 454 and 456, wherein 454 is a dielectric resonator and 456 is a combline resonator, are placed within the resonator assemblies 452 and connected to the underside by through holes, 458. Referring to FIG. 14C, planar resonators 474 and resistive elements 476 are constructed on the underside of the filter assembly and connected by throughholes 458 to the resonator assemblies 452 shown in FIG. 14B. The planar resonators 474 are well known in the art and the length of planar resonators 474 are normally around multiples of the quarter-wavelength for the desired frequency. Feed Lines 480 couple the signal to the planar resonators 474 and transmit the signal into and out of the cavity microwave filter assembly 450.

The embodiment in FIG. 14C uses single layer microstrip technology. Multi-layer stripline technology may also be used. Other technologies that can be used to implement the planar components include, but are not limited to, discrete elements, stripline technology, micro-electromechanical machine systems (MEMS) technology, radio frequency MEMS (RF MEMS) technology, radio frequency integrated circuit (RFIC) technology, and monolithic microwave integrated circuit (MMIC) technology. These technologies can implement a range of planar circuitry to be used as lossy components including, but not limited to, transistors, capacitors, inductors, resistors, diodes, amplifiers, mixers, switches, surface mount resistors, and electro-depositing lossy material onto a substrate. Uses of these components include, but are not limited to: achieving a wider range of resonator Q factors, achieving a wider range of coupling, achieving electronic tunability such as tuning the lossy design components, transmission line lengths or resonator Q factors, achieving tunable filters, designing active filters, boosting the rejection/in-band performance, and switching between channels when more than one filter is being used.

It will be appreciated that while the invention of a cavity microwave filter assembly with lossy networks has been described in the context of satellite communications in order to provide an application-specific illustration, it should be understood that the invention could also be applied to any other type of system desiring high Q factor filters. Alternatively, the invention could be applied in situations a large importance is placed on limiting the size and weight of the filter assembly.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A cavity microwave filter assembly for filtering an electromagnetic wave, said cavity microwave filter assembly having at least two representative nodes and comprising:

(a) a plurality of cavity resonator assemblies, each said cavity resonator assembly having a resonator cavity and an underside and being represented by a node; and (b) at least one lossy element inserted into the cavity microwave filter assembly between two nodes, wherein the at least one lossy element improves the frequency response of the cavity microwave filter assembly by improving the loss variation in the passband and increasing the sharpness at the band edges, wherein at least one of the nodes represents a cavity resonator assembly.

2. The cavity microwave filter assembly of claim 1, wherein the resonator assemblies are single mode or dual-mode resonator assemblies and wherein the resonator assemblies are selected from the group consisting of cavity, combline, and dielectric resonator assembly types.

3. The cavity microwave filter assembly of claim 2, wherein at least two resonator assemblies are different resonator assembly types.

4. The cavity microwave filter assembly of claim 1, wherein each of the plurality of cavity resonator assemblies have substantially similar Q factors.

5. The cavity microwave filter assembly of claim 1, wherein the at least one lossy element is a dissipative resonator with a different Q factor than at least one of the cavity resonator assemblies.

6. The cavity microwave filter assembly of claim 1, wherein the resonator assemblies further include lossy material positioned inside the resonator cavity.

7. The cavity microwave filter assembly of claim 1, wherein the lossy element comprises lossy material between two nodes.

8. The cavity microwave filter assembly of claim 6 or 7, wherein the lossy material is selected from the group consisting of dielectrics, ferrites, and conductors.

9. The cavity microwave filter assembly of claim 1, wherein the at least one lossy element comprises a complex coupling element comprising both real and resistive coupling in parallel between at least two nodes in the cavity microwave filter assembly.

10. The cavity microwave filter assembly of claim 1, wherein the at least one lossy element comprises at least one planar component selected from the group consisting of transistors, capacitors, inductors, diodes, amplifiers, mixers, switches, surface mount resistors, electro-deposited lossy type material.

11. The cavity microwave filter assembly of claim 10, wherein the at least one planar component is manufactured using a technology selected from the group consisting of discrete form, RFIC, MMIC, MEMS, and RF MEMS technology.

12. The cavity microwave filter assembly of claim 1, wherein the at least one lossy element is between two nodes of the cavity microwave filter assembly along the underside of at least one cavity resonator assembly using a through hole.

13. The cavity microwave filter assembly of claim 1, further comprising at least one planar resonator assembly.

14. The cavity microwave filter assembly of claim 13, wherein the at least one planar resonator assembly is implemented by microstrip technology or stripline technology.

15. The microwave filter assembly of claim 13, wherein the at least one planar resonator assembly is attached to the underside of at least one cavity resonator assembly using a through hole.

16. The microwave filter assembly of claim 12 or 15, wherein the through holes are filled with a dielectric material to improve mechanical stability.

17. The microwave filter assembly of claim 1, further comprising at least one input connection and at least one output connection, wherein each of the input and output connections are directly coupled to one of the resonator assemblies or to the at least one lossy element.

18. The microwave filter assembly of claim 1, wherein the resulting filter assembly has different loss levels for input return loss (S11) and output return loss (S22).

19. The microwave filter assembly of claim 18, wherein the input return loss and the output return loss can be independently varied.

20. A method for realizing the connection of a resistive element to at least one resonator within a representative node diagram by a physical circuit, the method comprising:

a. representing the resistive element using a representation of a circuit model, said circuit model comprising a resistor, a plurality of admittance inverters;

b. scaling the representative circuit model of the resistive element to obtain a desired resistor value and desired value of a coupling element, wherein a coupling element is analogous to an admittance inverter; and c. transforming the plurality of admittance inverters into a plurality of transmission lines and determining the physical transmission line lengths.

21. The method in claim 20, wherein the plurality of transmission lines comprise planar technology.

22. The method in claim 20, further comprising using network transforms to achieve different representative circuit model configurations.

* * * * *